US007859556B2

(12) United States Patent
Shoji et al.

(10) Patent No.: US 7,859,556 B2
(45) Date of Patent: Dec. 28, 2010

(54) THERMAL HEAD AND THERMAL PRINTER USING THE SAME

(75) Inventors: Noriyoshi Shoji, Chiba (JP); Yoshinori Sato, Chiba (JP); Hirokazu Suzuki, Chiba (JP)

(73) Assignee: Seiko Instruments Inc. (JP)

( * ) Notice: Subject to any disclaimer, the term of this patent is extended or adjusted under 35 U.S.C. 154(b) by 815 days.

(21) Appl. No.: 11/705,702

(22) Filed: Feb. 13, 2007

(65) Prior Publication Data

US 2008/0225104 A1 Sep. 18, 2008

(30) Foreign Application Priority Data

Feb. 27, 2006 (JP) ..... 2006-049704

(51) Int. Cl.
*B41J 2/335* (2006.01)

(52) U.S. Cl. ..... 347/203

(58) Field of Classification Search ..... 347/200, 347/203

See application file for complete search history.

(56) References Cited

U.S. PATENT DOCUMENTS 6,784,910 B2 * 8/2004 Sato et al. ..... 347/203

FOREIGN PATENT DOCUMENTS

| | | | |
|---|---|---|---|
| EP | 1 384 590 A1 | | 1/2004 |
| FR | 2 754 761 A | | 4/1998 |
| JP | 63 005964 A | | 1/1988 |
| JP | 1-118455 | * | 5/1989 |
| JP | 5-85666 | * | 4/1993 |

* cited by examiner

*Primary Examiner*—Huan H Tran
(74) *Attorney, Agent, or Firm*—Adams & Wilks

(57) ABSTRACT

A thermal head has a heat storage layer provided on an insulating substrate and a heat generating resistance layer provided on the heat storage layer. An individual electrode and a common electrode are formed on the heat generating resistance layer, and a protective film layer covers the electrodes and the heat generating resistance layer. A resin covering layer is formed on the surface of the protective film layer by applying and drying fluorine-based resin particles dissolved in a solvent on the surface.

15 Claims, 3 Drawing Sheets

THERMAL HEAD AND THERMAL PRINTER USING THE SAME

This application claims priority to Japanese Patent Application No. 2006-049704 filed Feb. 27, 2006, the entire content of which is hereby incorporated by reference.

BACKGROUND OF THE INVENTION

The present invention relates to a thermal head used as a printing element for a facsimile, a receipt printer, or the like and a thermal printer using the same, and more particularly, to a thermal printer of a type in which the thermal head and a platen roller serving as a recording medium feed mechanism member come into close contact with each other at all times and cannot be separated.

A thermal head is used as the printing element for thermal recording or thermal transfer recording performed by a facsimile, a receipt printer, or the like.

As a conventional thermal head, for example, as shown in FIG. 3, there has been known one having a structure in which on an upper surface of a heat storage layer 2 formed on a substrate 1, the heat storage layer 2 being formed of glass or the like and the substrate 1 being formed of alumina ceramics or the like, a large number of heat generating resistance layers 3 and individual electrodes 4 are arranged in a straight line, and are covered with a protective film layer 6 formed of an inorganic material such as silicon nitride or silicon oxide. While a recording medium 9 such as heat sensitive paper is allowed to slide on a surface of the protective film layer by a platen roller 8, each of the large number of heat generating resistance layers 3 is selectively caused to generate heat through electrification based on image data from outside, and the heat generated is conducted to the recording medium, thereby forming a predetermined print on the recording medium.

Note that, the protective film layer 6 serves for protecting the surfaces of the heat generating resistance layers 3, the individual electrodes 4, and a common electrode 5 from wear due to sliding with respect to the heat sensitive paper or the like, and from corrosion due to moisture or the like contained in the air. The protective film layer 6 is formed by forming a film of the inorganic material having a predetermined thickness on the surfaces of the heat generating resistance layers 3, the individual electrodes 4, and the common electrode 5 by conventional sputtering or the like.

Further, there is known a thermal head in which a fluorine-based resin is baked on the protective film layer 6 to prevent adhesion of paper dust and a conveyance failure (i.e., sticking) of the recording medium due to the adhesion of paper dust and the like.

However, a thermal head according to the above-related art, in some cases, cannot meet demands of a thermal printer including a mechanism to be described below.

In general, a thermal printer is composed of members such as a thermal head and a platen roller for conveying a recording medium while pressing the recording medium against the thermal head. As a method of inserting the recording medium between the thermal head and the platen roller, there are available a method performed when the thermal head and the platen roller are spaced apart from each other and a method performed when the thermal head and the platen roller are not spaced apart from each other. In a thermal printer having a structure in which the thermal head and the platen roller cannot be spaced apart from each other, in general, when it is recognized that the recording medium is located in proximity of the thermal head and the platen roller, the platen roller starts to rotate and the thermal head and the platen roller sandwiches the recording medium to start conveying the recording medium. However, in the thermal printer having the structure in which the thermal head and the platen roller cannot be spaced apart from each other, in a case where the thermal printer is preserved for a long period of time in a state where no recording medium is provided therein after shipment from a factory, or the like, the platen roller generally made of a rubber material may stick to the protective film of the thermal head to be fixed thereto.

In a case of the thermal head according to the above-related art, on the surface of the protective film on the heat generating resistance layers, a fluorine-based resin does not exist, so sticking partially occurs. Further, when an entire surface of a heater element portion is covered with a resin covering layer, there is a strong possibility of affecting heat generation of the thermal head, thereby deteriorating a print quality.

In such a thermal printer having the structure in which the thermal head and the platen roller cannot be spaced apart from each other, a member such as a spacer is generally interposed between the thermal head and the platen roller so that the thermal printer is prevented from being preserved without the recording medium provided therein, and the spacer is removed immediately before use.

The present invention has been made in view of the above-mentioned problem, and it is an object of the present invention to provide a thermal head and a thermal printer with which it is possible to form a fine print on a recording medium after start of printing even after a long-term preservation by preventing fixation caused by sticking between the thermal head and the platen roller to allow the recording medium to be conveyed in a stable manner.

SUMMARY OF THE INVENTION

According to the present invention, a thermal head includes an insulating substrate, a heat storage layer provided on the insulating substrate, a heat generating resistance layer provided on the heat storage layer, an individual electrode and a common electrode formed on the heat generating resistance layer, and a protective film layer covering the heat generating resistance layer, the individual electrode, and the common electrode, fluorine-based resin particles dissolved in a volatile solvent are applied onto a surface of the protective film layer and are dried to form a resin covering layer.

As a result, on a surface of the thermal head, there is formed the resin covering layer formed of the fluorine-based resin particles having an antifouling effect and a small coefficient of friction. Accordingly, the thermal head and the platen roller are prevented from sticking together due to the long-term preservation.

Further, the fluorine-based resin particles merely adhere onto the protective film of the thermal head with a weak adhesion force, so when recording paper is conveyed for the first time, the resin covering layer is easily removed from a heater element portion. Thus, after that, the fluorine-based resin particles do not affect the print quality of the thermal printer.

According to the present invention, in the thermal head, in which a large number of heat generating resistance layers are aligned on a substrate and the large number of heat generating resistance layers are covered with a protective film formed of an inorganic material, a resin covering layer formed of a fluorine-based resin adheres onto a surface of the protective film. Accordingly, due to properties of the fluorine-based resin forming the resin covering layer, including an antifouling effect and a small coefficient of friction, the thermal head and the platen roller do not stick to each other. Thus, with the thermal printer, in which a thermal head and a platen roller cannot be spaced apart from each other, it is possible to convey recording paper in a stable manner even after the long-term preservation.

Further, the fluorine-based resin particles are applied onto the protective film while being dissolved in a solvent. Therefore, adhesion of the fluorine-based resin particles is achieved only with a weak adhesion force, so when the recording paper is conveyed for the first time, the resin cove ring layer is easily removed from a heater element portion. Consequently, after that, the fluorine-based resin particles do not affect the print quality of the thermal printer in which heat generation of the thermal head and conveyance of recording paper are repeated.

Moreover, according to a method of the present invention, onto a surface of the thermal head, the fluorine-based resin particles dissolved in a volatile solvent are applied and are then merely air-dried at normal temperature, so it is possible to perform covering remarkably easily as compared to a method involving a heat treatment or the like. Thus, it is possible to markedly suppress production costs.

DETAILED DESCRIPTION OF THE INVENTION

Figure 1:
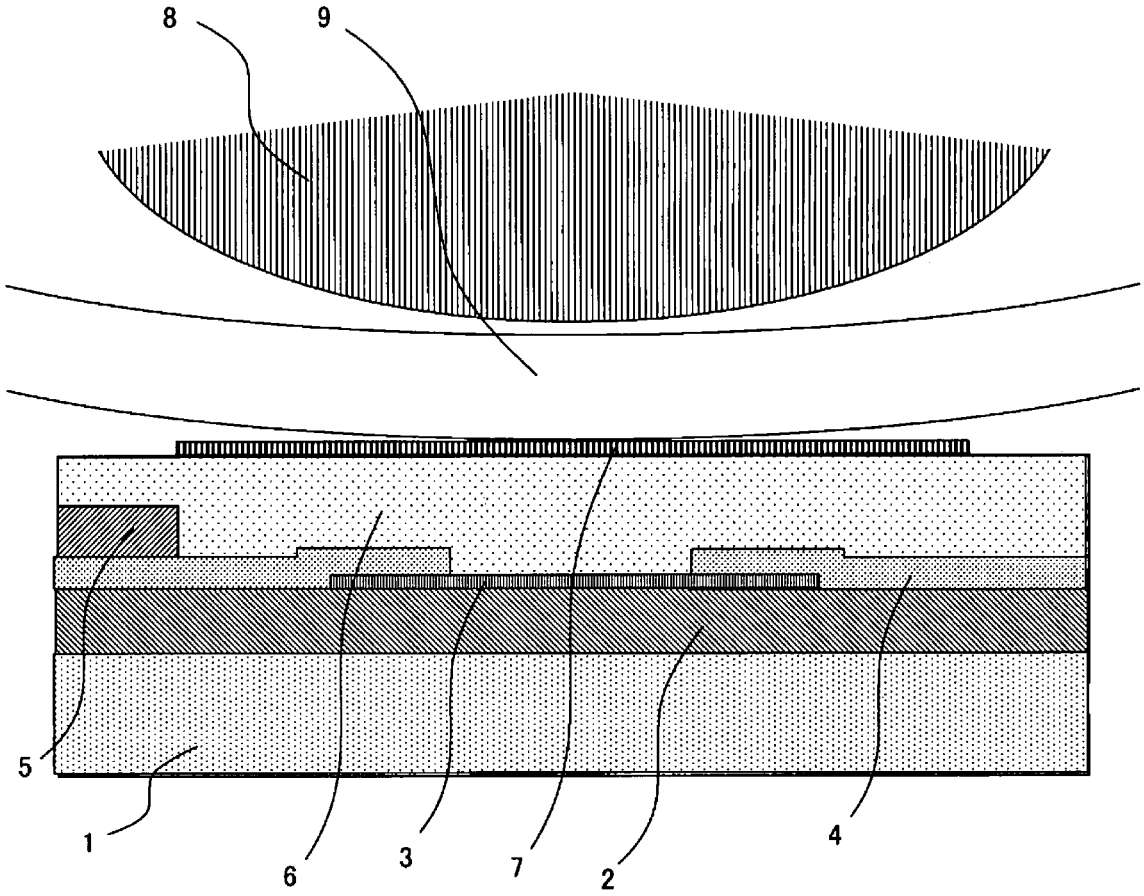
FIG. 1 is a sectional view of a thermal head and a platen roller according to an embodiment of the present invention.
Figure 2:
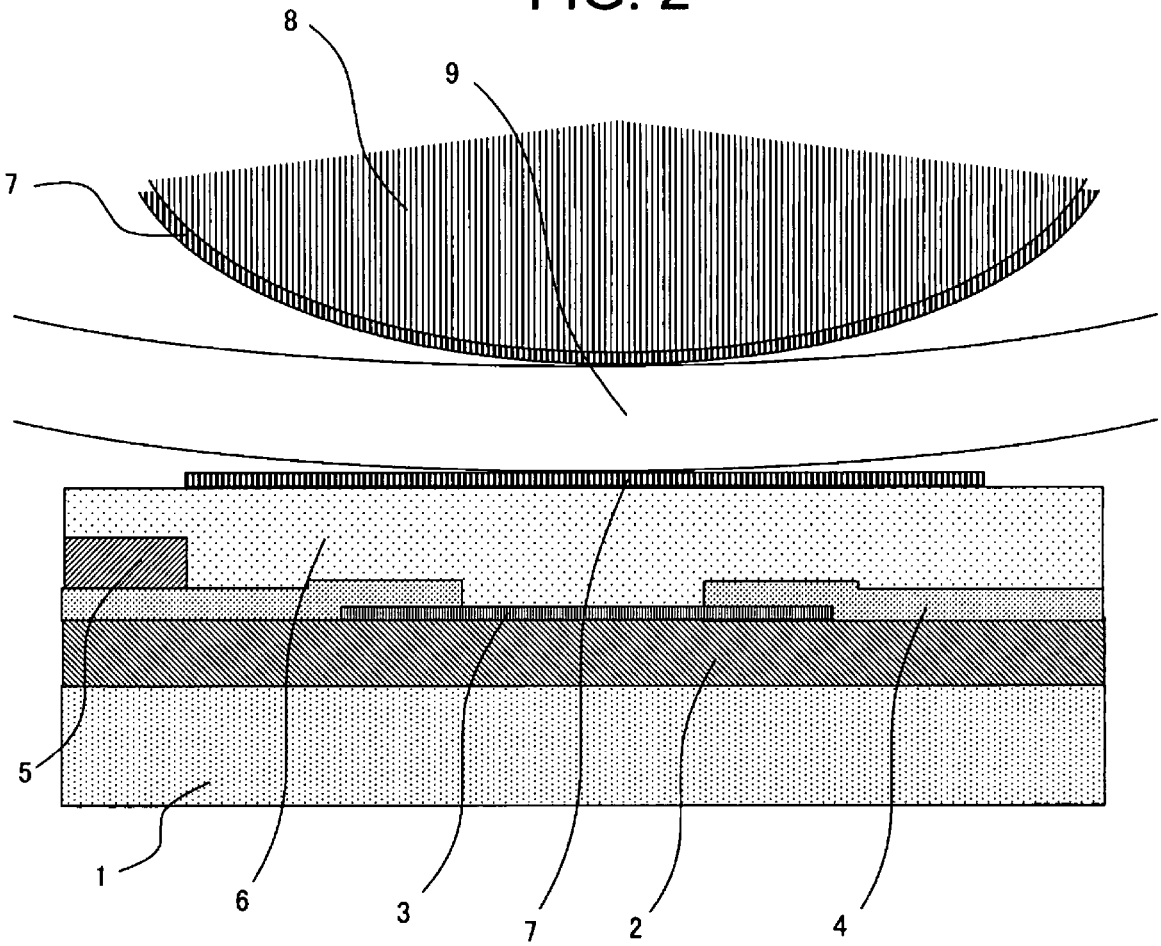
FIG. 2 is a sectional view of a thermal head and a platen roller according to another embodiment of the present invention.
Figure 3:
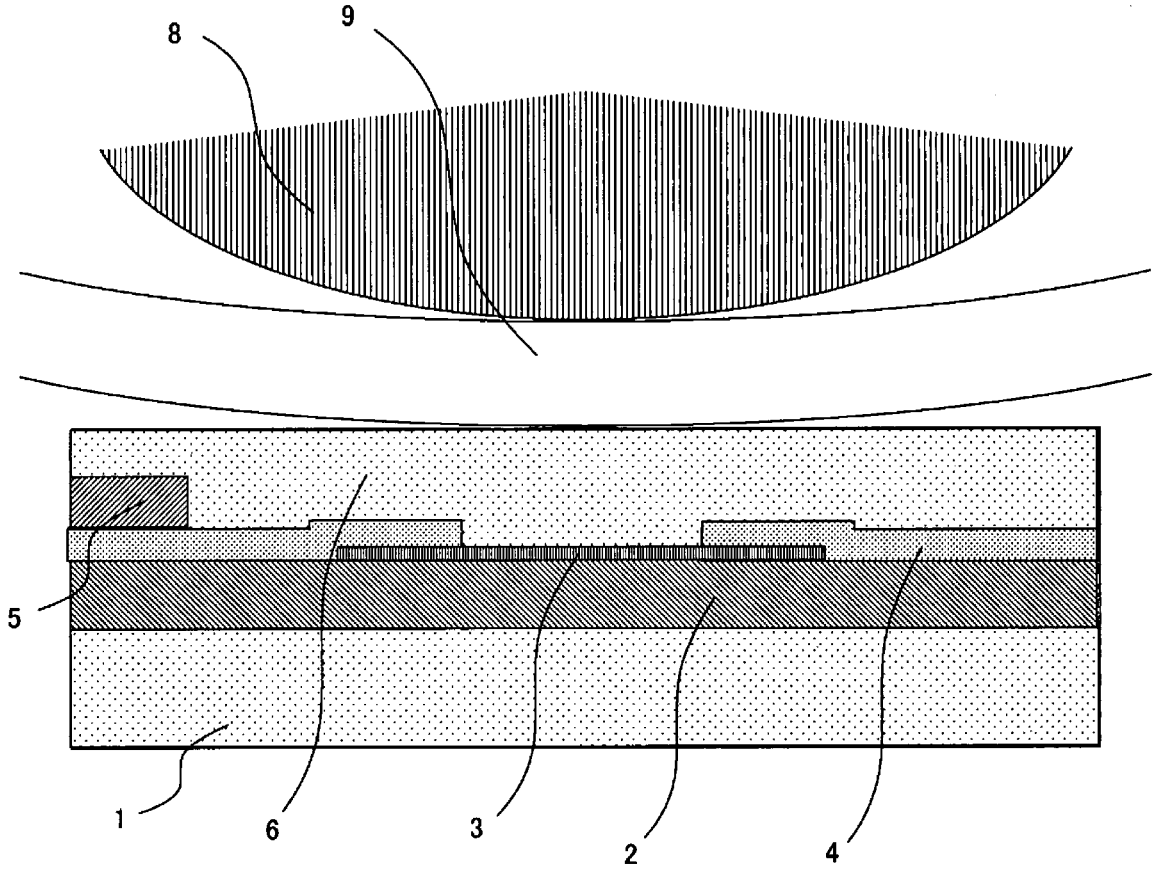
FIG. 3 PRIOR ART
FIG. 3 is a sectional view of a normal thermal head and a platen roller according to a prior art.

Hereinafter, the present invention will be described in detail with reference to the drawings. FIG. 1 is a sectional view of a thermal head and a platen roller of a thermal printer according to an embodiment of the present invention. FIG. 2 is a sectional view of a thermal head and a platen roller of a thermal printer according to another embodiment of the present invention.

A substrate 1 is an insulating substrate such as an alumina ceramics substrate typically used for the thermal head. In a case where the alumina ceramics substrate is used, on the substrate 1, there is formed a heat storage layer 2 of glass or the like for making calorie of a heat generating resistance layer 3, which has generated heat, be difficult to be discharged to the substrate.

Hereinafter, a thermal head formed by a thin film process will be used as an example for describing the present invention in detail. On the heat storage layer 2, by a thin film forming method such as sputtering, CVD (chemical vapor deposition), or vapor deposition, the heat generating resistance layer 3 formed of a metallic compound or the like including tantalum nitride and nickel-chromium is stacked, and patterning is performed by a photolithography process using a photoresist material, and then through an etching process of removing a non-photoresist-covering portion, a pattern of the heat generating resistance layer 3 is formed. The patterned heat generating resistance layer 3 defines a pattern of heat-generating resistance elements. In the same manner, a wiring pattern of individual electrodes 4 formed of aluminum, copper, gold, silver, or the like is stacked to form a heat generating resistance element portion.

Regarding a common electrode 5, provision of only wiring of the individual electrodes 4 leads to a problem of voltage reduction or the like. Therefore, as needed, for example, a process in which aluminum or the like is formed in a thick film by vapor deposition or the like or in which silver, palladium, platinum, or the like is formed to be thick by printing is added, thereby reducing a wiring resistance value. Note that, setting for this process may be performed before forming the patterns of the heat generating resistance layers 3 and the individual electrodes 4.

Further, in an upper layer, a protective film layer 6 covers the heat generating resistance layers 3, the individual electrodes 4, and the common electrode 5, for protecting those from wear due to sliding with respect to heat sensitive paper or the like and from corrosion due to contact with moisture or the like contained in the air. As a material for the protective film layer 6, in general, a silicon nitride material and a silicon oxide material are known, and tantalum pentoxide, SIALON, silicon carbide, diamond-like carbon, or the like are used as well.

Hereinafter, formation of a fluorine-based resin covering layer according to the present invention will be described in detail.

The fluorine-based resin particles used in the present invention are formed of a resin of fluoropolymer such as polytetrafluoroethylene or chlorotrifluoroethylene. Of those, in particular, polytetrafluoroethylene is remarkably excellent in coefficient of friction and heat resistant temperature, and is a fluororesin which is most commonly distributed in the market.

In the present invention, the above-mentioned resin is made into a powder form having a particle size of 0.05 μm to 5 μm. The powder is mixed into a volatile solvent together with a small amount of binder before being used. It is desirable to use the volatile solvent whose ozone-depleting potential is zero. For example, hydrofluoro ether or the like is suitable.

The resultant obtained as described above is applied onto the protective film layer 6 of the heater element portion of the thermal head (application process). A method of application is not limited and the application with a brush or the like is convenient, so is desirable. The above-mentioned solvent is very highly volatile and dries rapidly. Therefore, after the application, after the composition has been left to stand for about ten seconds, a resin covering layer 7 is formed (drying process). In this case, according to the number of times of application or an amount of the solvent, a film thickness of the resin covering layer 7 to be formed can be roughly controlled. Note that, it is desirable that the thickness be set to 0.5 μm to 20 μm.

In the thermal printer to which the thermal head is installed, a platen roller 8 having a diameter of about 5 mm to 20 mm is supported above the heat generating resistance layers 3 so as to be rotatable. The platen roller 8 presses a recording medium 9 onto the surface of the thermal head while the recording medium 9 is conveyed in a direction perpendicular to an alignment direction of the heat generating resistance layers 3 to selectively allow the heat generating resistance layers 3 of the thermal head to generate heat based on image data from outside. The heat generated is conducted to the recording medium to form a print, thereby performing a series of recording operations.

In ordinary cases, it suffices that covering with the fluorine-based resin is performed only on the thermal head, but it may be performed on the platen roller 8 instead of the thermal head. Further, in order to enhance the effect thereof, it may be performed on both the thermal head and the platen roller as shown in FIG. 2. When the platen roller 8 is subjected to this treatment, the application with a brush or the like becomes time consuming, so a method of dipping the platen roller 8 in the solvent is effective.

Before being used after completion, the thermal printer having a structure, in which the thermal head and the platen roller cannot be spaced apart from each other, is in a state where the protective layer 6 of the thermal head and the platen roller 8 are pressed to each other at all times. In this case, depending on a preservation time period and a preservation environment, the platen roller 8 formed of a rubber material may stick to the protective film layer 6 of the thermal head in some cases.

According to the present invention, in a thermal head, in which the plurality of heat generating resistance layers 3 are aligned on the upper surface of the substrate and the plurality of heat generating resistance layers 3 are covered with the protective film layer 6 formed of an inorganic material, the surface of the protective layer 6 is covered with the resin covering layer 7 formed of a fluorine-based resin. Accordingly, due to the properties of the fluorine-based resin constituting the resin covering layer, including the antifouling effect and the small coefficient of friction, the thermal head and the platen roller do not stick to each other. Thus, with the thermal printer, in which the thermal head and the platen roller cannot be spaced apart from each other, it is possible to convey recording paper continuously in a stable manner even after the long-term preservation.

As an example of using such the thermal printer, in which the thermal head and the platen roller cannot be spaced apart from each other, there is proposed a thermal printer including a sensor provided in proximity of the thermal head and the platen roller 8, for sensing presence/absence of the recording medium 9, in which when the recording medium 9 is detected, the platen roller 8 starts rotating to start conveying the recording medium 9.

As described above, due to the properties of the resin covering layer 7, including the antifouling effect and the small coefficient of friction, the thermal head and the platen roller do not stick to each other. However, in a case where a film-like member exists on the protective film of the thermal head, there is an apprehension that the print quality is affected. In a case where a material having a sufficient film thickness exists between the thermal head and the platen roller, it is conceivable that the heat generated is difficult to be conducted to the recording medium 9, so it is easily assumed that the print quality is adversely affected.

However, the fluorine-based resin particles are applied onto the protective film layer 6 of the thermal head while being dissolved in a solvent. Therefore, adhesion of the fluorine-based resin particles is achieved only with a weak adhesion force, so when the recording medium 9 is conveyed for the first time, the resin covering layer 7 is easily removed from the surface of the protective film layer 6 of the heater element portion due to frictional contact of the resin covering layer with the recording medium. Thus, after that, the fluorine-based resin particles do not affect the print quality of the thermal printer in which heat generation of the thermal head and conveyance of recording medium 9 are repeated.

Further, according to the method of the present invention, on the surface of the thermal head, the fluorine-based resin particles dissolved in a volatile solvent are applied and then merely air drying is performed at normal temperature, so it is possible to perform covering remarkably easily as compared to a method involving a heat treatment or the like. Thus, it is possible to reduce the number of processes, to thereby markedly suppress production costs.

Moreover, by performing application of the fluorine-based resin particles in a liquid state like in the present invention, it is also possible to reduce the cost of materials. To be specific, the cost of materials required is about 10,000 yen/kg, and more than 10,000 thermal heads of 2-inch size can be processed at the above-mentioned cost. Therefore, the cost for one thermal head is equal to or less than one yen.

Note that, the present invention is not limited to the embodiment described above, and various modifications, improvements, and the like can be made without departing from the gist of the present invention.

For example, in the embodiment of the present invention, the description is made of a thin film thermal head. However, as a matter of course, with a thick film thermal head, it is possible to obtain the same effects.

The invention claimed is:

1. A thermal printer, comprising:

a thermal head comprising an insulating substrate;

a heat storage layer provided on the insulating substrate;

a heat generating resistance layer provided on the heat storage layer;

an individual electrode and a common electrode formed on the heat generating resistance layer;

a protective film layer covering the heat generating resistance layer, the individual electrode, and the common electrode; and a resin covering layer formed by applying and drying fluorine-based resin particles dissolved in a volatile solvent on a surface of the protective film layer; and a platen roller for conveying a recording medium while pressing the recording medium against the thermal head, the platen roller having a fluorine-based resin covering layer formed thereon, wherein as the thermal printer conveys the recording medium while pressing the recording medium, the resin covering layer is removed from the surface of the protective film layer.

2. A thermal printer according to claim 1; wherein the fluorine-based resin particles are polytetrafluoroethylene resin particles.

3. A thermal printer according to claim 1; wherein the fluorine-based resin particles each have a diameter of 0.05 μm to 5 μm.

4. A thermal printer according to claim 1; wherein the resin covering layer has a thickness of 0.5 μm to 20 μm.

5. A thermal printer, comprising:

a thermal head comprising an insulating substrate;

a heat storage layer provided on the insulating substrate;

a heat generating resistance layer provided on the heat storage layer;

an individual electrode and a common electrode formed on the heat generating resistance layer;

a protective film layer covering the heat generating resistance layer, the individual electrode, and the common electrode; and a resin covering layer formed by applying and drying fluorine-based resin particles dissolved in a volatile solvent on a surface of the protective film layer; and a platen roller for conveying a recording medium while pressing the recording medium against the thermal head, wherein the thermal head and the platen roller cannot be spaced apart from each other.

6. A thermal printer according to claim 5; wherein the fluorine-based resin particles are polytetrafluoroethylene resin particles.

7. A thermal printer according to claim 5; wherein the fluorine-based resin particles each have a diameter of 0.05 μm to 5 μm.

8. A thermal printer according to claim 5; wherein the resin covering layer has a thickness of 0.5 μm to 20 μm.

9. A thermal head for printing on a recording medium conveyed between the thermal head and a platen roller that presses the recording medium into contact with the thermal head, the thermal head comprising:

an insulating substrate;

a heat storage layer provided on the insulating substrate;

heat-generating resistance elements provided on the heat storage layer;

electrodes provided on the heat storage layer and connected to the heat-generating resistance elements;

a protective film layer adhered to and covering the heat-generating resistance elements and the electrodes; and a resin covering layer removably adhered to and covering the protective film layer at least in the region where the protective film layer covers the heat-generating resistance elements, the resin covering layer being removable from the protective film layer by frictional contact between the resin covering layer and a recording medium during first-time use of the thermal head.

10. A thermal head according to claim 9; wherein the resin covering layer contains fluorine-based resin particles.

11. A thermal printer according to claim 10; wherein the fluorine-based resin particles are polytetrafluoroethylene resin particles.

12. A thermal printer according to claim 10; wherein the fluorine-based resin particles each have a diameter of 0.05 μm to 5 μm.

13. A thermal printer according to claim 10; wherein the resin covering layer has a thickness of 0.5 μm to 20 μm.

14. A thermal printer comprising: the thermal head according to claim 9; and a platen roller in pressing contact with the thermal head; wherein the resin covering layer prevents the platen roller from sticking to the protective film layer of the thermal head prior to first-time use of the thermal printer.

15. A thermal printer according to claim 14; wherein the thermal head and the platen roller are fixed in place relative to each other and cannot be spaced apart from one another.

* * * * *